US009739579B2

(12) United States Patent
Beal

(10) Patent No.: US 9,739,579 B2
(45) Date of Patent: Aug. 22, 2017

(54) FIREARM AMMUNITION CASE INSERT

(71) Applicant: Strategic Armory Corps, LLC, Phoenix, AZ (US)

(72) Inventor: Harold F. Beal, Rockford, TN (US)

(73) Assignee: Strategic Armory Corps, LLC, Phoenix, AZ (US)

( * ) Notice: Subject to any disclaimer, the term of this patent is extended or adjusted under 35 U.S.C. 154(b) by 0 days.

(21) Appl. No.: 14/822,183

(22) Filed: Aug. 10, 2015

(65) Prior Publication Data

US 2016/0054105 A1 Feb. 25, 2016

Related U.S. Application Data

(60) Provisional application No. 62/040,781, filed on Aug. 22, 2014.

(51) Int. Cl.
*F42B 5/02* (2006.01)
*F42B 5/16* (2006.01)
*F42C 19/08* (2006.01)

(52) U.S. Cl.
CPC ..... *F42B 5/02* (2013.01); *F42B 5/16* (2013.01); *F42C 19/0807* (2013.01)

(58) Field of Classification Search
CPC ..... F42B 5/02; F42B 5/16; F42B 5/26; F42B 5/285; F42B 5/307; F42B 5/34; F42B 8/10; F42B 8/16; F42B 33/02; F42B 33/0207; F42B 33/0285; F42B 33/0292
USPC ..... 102/464, 443, 444, 447, 455, 467
See application file for complete search history.

(56) References Cited

U.S. PATENT DOCUMENTS 539,327 A * 5/1895 Aikin ..... F42B 8/02 102/447
2,263,941 A * 11/1941 Albree ..... F42B 5/02 102/464
3,099,958 A * 8/1963 Daubenspeck ..... F42B 7/06 102/449
3,245,348 A * 4/1966 Lahr ..... F41C 3/00 102/441
3,829,537 A * 8/1974 Rosenthal ..... C06B 21/0091 149/100
4,157,684 A * 6/1979 Clausser ..... F42B 5/02 102/430
4,173,186 A * 11/1979 Dunham ..... F42B 29/00 102/430
5,359,937 A * 11/1994 Dittrich ..... F42B 14/064 102/430
5,677,505 A * 10/1997 Dittrich ..... F42B 5/02 102/430

(Continued)

*Primary Examiner* — John D Cooper
(74) *Attorney, Agent, or Firm* — Pitts & Lake, P.C.

(57) ABSTRACT

A firearm ammunition cartridge comprises a case having a substantially tubular body portion, an open leading end, and a trailing end defining a primer port. An insert is received within the case and extending along the body portion. The insert has an exterior surface conforming to an interior surface of the body portion and a central cavity extending along an axial dimension of the insert. The central cavity opens to the primer port at the trailing end of the case and to a leading end of the insert. A quantity of gunpowder is disposed within the central cavity, and a projectile is received and retained within the leading end of the case. The gunpowder is confined to a chamber comprising at least a portion of the central cavity between said case trailing end and the projectile.

16 Claims, 2 Drawing Sheets

(56) References Cited

U.S. PATENT DOCUMENTS

| | | | | |
|---|---|---|---|---|
| 5,770,815 | A * | 6/1998 | Watson, Jr. | F42B 5/16 102/439 |
| 6,283,035 | B1 * | 9/2001 | Olson | F42B 5/02 102/439 |
| 9,182,204 | B2 * | 11/2015 | Maljkovic | F42B 33/10 |
| 9,200,880 | B1 * | 12/2015 | Foren | F42B 33/02 |
| 2010/0275804 | A1 * | 11/2010 | Trivette | F42B 5/30 102/448 |
| 2013/0014664 | A1 * | 1/2013 | Padgett | F42B 5/313 102/439 |
| 2014/0060373 | A1 * | 3/2014 | Maljkovic | F42B 33/10 102/467 |

* cited by examiner

FIREARM AMMUNITION CASE INSERT

CROSS-REFERENCE TO RELATED APPLICATIONS

This application claims the benefit of U.S. Provisional Patent Application No. 62/040,781, filed on Aug. 22, 2014, which is incorporated herein in its entirety by reference.

STATEMENT REGARDING FEDERALLY-SPONSORED RESEARCH OR DEVELOPMENT

Not Applicable

BACKGROUND OF THE INVENTION

1. Field of Invention

This invention relates to firearm ammunition and methods of manufacture thereof. More particularly, this invention relates to an insert for firearm ammunition which may encourage a more consistent ignition of gunpowder during firing of the ammunition.

2. Description of the Related Art

Ammunition cartridges of the type commonly used in modern firearms are generally known in the art. An ammunition cartridge typically includes a generally cylindrical case which is sized and shaped to correspond to the interior of a firing chamber of a firearm. The case includes an open leading end having a projectile held therein. When the cartridge is received within the chamber, the leading end of the case carrying the projectile faces toward and along the bore of the firearm. A primer is fixed proximate a trailing end of the case, such that the case and primer cooperate to seal the firing chamber of the firearm in all directions except toward the bore of the firearm. The primer includes a small charge of impact-sensitive, ignitable chemical mixture. When the firearm is fired, a firing pin strikes the primer and ignites the chemical mixture. The chemical mixture deflagrates to produce a jet of burning gas within the case. This burning gas is used to ignite a measure of propellant, typically gunpowder, housed within the case. When burned, the propellant produces significant quantities of gasses which push the projectile from the open end of the case, down the bore, and out from the muzzle of the firearm.

The velocity at which the projectile is discharged from the muzzle of the firearm is a function of, among other things, the quantity of propellant burned in the case, and thus the quantity of gasses produced, during the firing process, and the rate at which the propellant is burned and the gasses are produced. Thus, in order to achieve a desired velocity of the projectile from the firearm muzzle, the volume of propellant housed within the case of a given ammunition cartridge is often carefully selected and measured during manufacture of the cartridge. Typically, the volume of propellant selected for a given ammunition cartridge does not fill the entire volume of the case interior, and a void is allowed within the case.

In certain shooting situations, it is desirable to provide a measure of propellant within the case which leaves a substantial portion of the interior volume of the case void of propellant. For example, in certain shooting situations, it is desirable that the projectile fired from a firearm travel at less than supersonic velocity. This shooting situation can occur, for example, in the course of military and law enforcement activities, such as in sniper fire or other activity wherein it is desired that the location of the shooter not be detectable by reason of the sound associated with the firing of the firearm and the path of travel of the projectile. Firearm ammunition heretofore intended to provide for subsonic velocity of the projectile thereof upon firing of the ammunition traditionally has been manufactured by providing a reduced quantity of gunpowder in the case of each round of the ammunition as compared to sonic or supersonic loads of the same size and caliber. This method often leaves a very substantial portion of the interior volume of the subsonic ammunition case void of either powder and/or projectile.

In ammunition cartridges of the type described above, in which a large void is provided in the case, the propellant within the case is free to flow into one or the other end of the case, depending upon whether the firearm being used is aimed upwardly from the horizontal or downwardly from the horizontal. When the propellant shifts to the leading end of the case (adjacent the projectile and away from the primer in the closed end of the case), the jet of burning gas generated upon the firing pin striking the primer must pass through the void space between the primer and the propellant before reaching and igniting the propellant. This situation creates at least two undesirable factors, namely: (a) delay or failure in ignition of the propellant and/or (b) poor exposure of the propellant to the burning gas. The first of these factors can be so serious as to cause the shooter to believe that he has experienced a misfire, to cause the shooter to pull his/her sight off the target, and/or to damage the firearm. The second of these factors may result in insufficient ignition of the propellant and a burn pattern of the propellant which causes inconsistent propulsion of the projectile from the firearm, hence impairment of the shooter to hit a desired target at a desired velocity. When the powder shifts toward the primer-containing closed end of the case, these factors are generally reversed, causing undesirable increase in burn rate of the propellant, and corresponding increase in velocity of the projectile, as well as other deleterious results.

In light of the above, a cartridge of firearm ammunition which achieves more consistent ignition of the gunpowder within the case of the cartridge throughout a broad range of orientations of the round is desired. Other objects and advantages of the present general inventive concept will be recognized from the present specification, including the claims and the drawings appended hereto.

BRIEF SUMMARY OF THE INVENTION

The present general inventive concept, in various embodiments, provides an insert for a firearm ammunition cartridge which maintains a quantity of gunpowder in a relatively stable position within the cartridge, and a firearm ammunition cartridge having such an insert. Various example embodiments of the present general inventive concept may be achieved by providing a case having a substantially tubular body portion, an open leading end, and a trailing end defining a primer port, the primer port opening to an interior of the case. An insert may be received within the case and may extend along the body portion. The insert may have an exterior surface conforming to an interior surface of the body portion and a central cavity extending along an axial dimension of the insert. The central cavity may open to the primer port at the trailing end of the case and may open to a leading end of the insert. A quantity of gunpowder may be disposed within the central cavity. A projectile may be received and retained within the leading end of the case. Thus, the gunpowder may be confined to a chamber comprising at least a portion of the central cavity between the case trailing end and the projectile.

In various example embodiments of the present general inventive concept, a trailing end of the projectile may close a leading end of the central cavity. In various embodiments, the quantity of gunpowder may define a volume approximately equal to a volume of the central cavity between the trailing end of the projectile and the trailing end of the case. In various embodiments, the central cavity may define a cylindrical leading portion having a first diameter and a cylindrical trailing portion having a second diameter. In various embodiments, the leading portion and the trailing portion of the central cavity may be coaxial with one another and with an axial dimension of the primer port. In various embodiments, the leading portion of the central cavity may have a diameter substantially equal to a trailing end of the projectile. In various embodiments, the trailing end of the projectile may be received within the leading portion of the central cavity. In various embodiments, the trailing portion of the central cavity may have a diameter substantially equal to a diameter of the primer port. In various embodiments, the leading portion of the central cavity may have a diameter greater than a diameter of the trailing portion. In various embodiments, the central cavity may further define a cylindrical central portion having a third diameter. In various embodiments, the leading portion of the central cavity may a diameter substantially equal to a trailing end of the projectile, the trailing portion of the central cavity may have a diameter substantially equal to a diameter of the primer port, and the central portion of the central cavity may have a diameter greater than the diameter of the leading portion and the diameter of the trailing portion. In such embodiments, the trailing end of the projectile may be received within the leading portion of the central cavity. In various embodiments, the insert may be fixed within the case. In various embodiments, the case may define a tapered portion between the body portion and the leading end, and the exterior surface of the insert may have a leading portion conforming to an interior surface of the tapered portion of the case. Thus, the tapered portion may retain the insert within the case between the tapered portion and the trailing end of the case.

Various example embodiments of the present general inventive concept may be achieved by providing an insert for a firearm ammunition case comprising a substantially rigid member defining a leading end, an opposite trailing end, and an exterior surface between the leading and trailing ends. The exterior surface may be shaped to conform to at least a portion of an interior surface of a firearm ammunition case between a trailing end of the case and a leading tapered portion of the case. The member may further define a central cavity extending between and opening to the leading and trailing ends of the member. The central cavity may be sized to receive a quantity of gunpowder therein and to maintain the quantity of gunpowder proximate a trailing end of the case.

In various example embodiments of the present general inventive concept, the exterior surface may define a tapered portion proximate the leading end. The tapered portion may be shaped to conform to an interior surface of a tapered portion of a firearm ammunition case. In various embodiments, the central cavity may define a cylindrical leading portion having a first diameter and a cylindrical trailing portion having a second diameter. In various embodiments, the leading portion and the trailing portion of the central cavity may be coaxial with one another and with an axial dimension of the exterior surface. In various embodiments, the leading portion of the central cavity may have a diameter substantially equal to a trailing end of an ammunition projectile. In various embodiments, the trailing portion of the central cavity may have a diameter substantially equal to a diameter of an ammunition primer port. In various embodiments, the central cavity may further define a cylindrical central portion having a third diameter greater than the first and second diameters.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Reference will now be made to the example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper," "trailing," "leading," and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath"

other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 2:
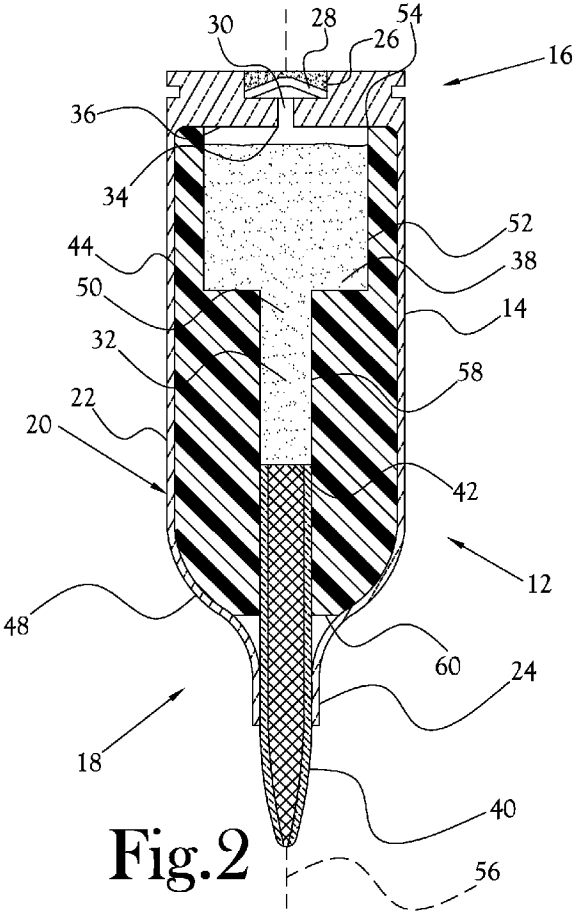
FIG. 2 is another cross-sectional side view of the embodiment of FIG. 1.
Figure 1:
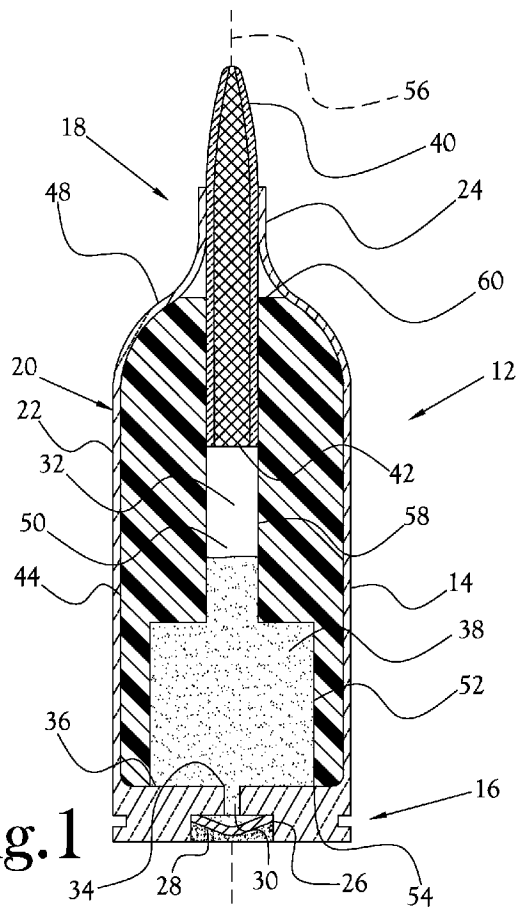
FIG. 1 is a cross-sectional side view of one embodiment of a round of firearm ammunition embodying various features of the present general inventive concept.

With reference now to FIGS. 1 and 2, there is depicted a cross-sectional view of one embodiment of a firearm ammunition cartridge 12 constructed in accordance with several features of the present general inventive concept. The firearm ammunition cartridge 12, or "cartridge," includes a case 14 of the type having a trailing end 16, an open leading end 18, and a body 20 which includes a generally hollow trailing tubular portion 22 that transitions into a "necked down" leading tubular portion 24. The trailing end 16 of the case is substantially closed and includes a primer port 26 within which there is disposed a primer 28. The primer port 26 is accessible from the exterior of the case and includes a flame port 30 leading therefrom and into the interior volume 32 of the case. Notably, the flame port 30 comprises a straight through bore having an inwardly terminal opening whose rim 34 is defined by the junction of the straight wall of the through bore with the inside rearward wall 36 of the case which is oriented normally of the wall of the through bore. By this means, the rim 34 is sharply defined so that a flame generated by the firing of the primer 28 exits the flame port 30 in a substantially collimated flame that projects itself into the interior volume 32 of the case to ignite a powder charge 38 disposed therein.

A projectile 40 is disposed in and closes the leading end 18 of the case. A charge of gunpowder 38 is disposed within the case interior 32 and occupies at least a portion of the case interior 32 between a trailing end 42 of the projectile 40 and the flame port 30 of the case. When the gunpowder 38 is exposed to burning gas generated by the firing of the primer 28 at the trailing end 16 of the case, the gunpowder 38 is ignited and burns, resulting in a buildup of gas pressure within the case 14 sufficient to propel the projectile 40 from the leading end 18 of the case 14, along the barrel of the firearm, and outwardly therefrom, thereby firing the projectile 40 from the firearm. In several embodiments, the combustion of the gunpowder 38, and the corresponding buildup of gas pressure within the case 14 and barrel of the firearm, is further sufficient to operate one or more gas-operated features of the firearm, such as for example a gas-operated bolt, slide, or other such mechanism of the firearm.

While in the illustrated embodiment the above-discussed propellant employed in the cartridge 12 is a measure of gunpowder 38, it will be recognized that other substances may be used to accomplish the propellant without departing from the spirit and scope of the present general inventive concept. To this end, as used herein, the terms "gunpowder," "powder charge," and the like will be understood to encompass various types of granular and/or fluid materials suitable for use as a propellant in an ammunition cartridge. For example, it will be recognized that, in certain embodiments, smokeless gunpowder, black powder, flash powder, or other similar substances may be used as propellant in the cartridge 12 as described herein without departing from the spirit and scope of the present general inventive concept.

The specific quantity and/or volume of gunpowder 38 within the case 14 is sufficient such that, upon ignition and combustion of the gunpowder 38, sufficient gas pressure is developed within the case 14 to propel the projectile 40 at a desired velocity, while simultaneously generating and sustaining any minimum gas pressure necessary within the firearm in order to operate the various mechanical components of the firearm. To this end, it will be recognized that the exact quantity and/or volume of gunpowder 38 contained within the case 14 may vary depending upon several factors, including, but not limited to, the given characteristics of the particular gunpowder employed (i.e., its burn rate, etc.), the given characteristics of the particular projectile 40 to be fired (i.e., caliber, mass, shape, dimensions, etc.), the dimensional characteristics of the case 14, the characteristics of the firearm from which the ammunition is to be fired, and the specific needs and/or desires of the user for the specific round of ammunition. In several embodiments, the charge of gunpowder 38 occupies materially less than all of the interior volume 32 of the case 14, and in some embodiments less than 50% of the total volume of the interior 32 of the case 14.

As noted, the present general inventive concept may, in several embodiments, address the problem of maintaining at least a significant portion of the gunpowder 38 in a relatively stable position within the case, while limiting, and in some embodiments minimizing, the development of void spaces not occupied by the volume of gunpowder 38 between the flame port 30 and the rear surface 42 of the projectile 40, thereby ensuring a more consistent ignition of the gunpowder within the case throughout a range of orientations of the round of ammunition. To this end, in the illustrated embodiment, an insert 44 is provided within the case interior 32 to reduce the overall effective volume of case interior 32 which may be occupied by the gunpowder 38 and to maintain at least a portion of the powder charge 38 in a location between the flame port 30 and the projectile 40, accessible by the jet of burning gas projected through the flame port 30 from the primer 28. In the embodiment of FIG. 1, the insert 44 is generally tubular in shape, having an outer circumferential surface which substantially matches the internal surface of the trailing tubular portion 22 of the case. In the illustrated embodiment, the insert 44 extends between the interior of the trailing end 16 of the casing and the trailing end of the leading tubular portion 24 of the case. Thus, a leading end 60 of the insert 44 defines a tapered shape substantially conforming to the interior surface of the tapered portion 48 of the case 14 between the trailing tubular portion 22 and the leading tubular portion 18. In this embodiment, the tapered portion 48 of the case 14 serves to secure the insert 44 generally within the case interior 32 along the length of the trailing tubular portion 22. In certain embodiments, the outer surface of the insert 44 may further be frictionally engaged or otherwise secured to the interior surface of the trailing tubular portion 22. However, it will be recognized that such additional engagement is not necessary in order to accomplish the present invention.

In various embodiments, the insert 44 defines an open-ended central cavity 50 extending generally along a central coaxis 56 of the insert 44 and the case 14. In the illustrated embodiment, the central cavity 50 comprises a through bore having a relatively wide, cylindrical trailing portion 52 which opens axially to a trailing end 54 of the insert 44 adjacent the flame port 30 of the case 14. The trailing portion 52 of the central cavity 50 transitions to a cylindrical leading portion 58 having a diameter narrower than that of the trailing portion 52. In several embodiments, the powder charge 38 is confined entirely within the central cavity 50 between the flame port 30 and the trailing end 42 of the projectile 40. For example, in the illustrated embodiment, the diameter of the leading portion 58 of the central cavity 50 substantially matches the outer diameter of the trailing end 42 of the projectile 40, and the trailing end 42 of the projectile 40 extends into the leading portion 58 of the central cavity 50, thereby closing the leading end 60 of the insert 44 and containing the powder charge 38 within the central cavity 50. In another embodiment, the diameter of the leading portion 58 of the central cavity 50 is less than the outer diameter of the trailing end 42 of the projectile 40, and the trailing end 42 of the projectile 40 abuts the leading end 60 of the insert 44 adjacent the leading portion 58 of the central cavity 50, thereby closing the leading end 60 of the insert 44. In various other embodiments, gunpowder 38 may flow from the central cavity 50 into the region of the case interior 32 surrounding the trailing end 42 of the projectile 40. For example, in certain embodiments, the diameter of the leading portion 58 of the central cavity 50 is greater than the outer diameter of the trailing end 42 of the projectile 40. In other embodiments, the trailing end 42 of the projectile 40 terminates forward of the leading end 60 of the insert 44. However, in various embodiments, including embodiments in which the gunpowder 38 is maintained entirely within the central cavity 50 and embodiments in which a portion of the gunpowder 38 may flow from the central cavity 50 into the region of the case interior 32 surrounding the trailing end 42 of the projectile 40, the size of the central cavity 50 in relation to the remainder of the case interior 32 is such that at least a portion of the gunpowder forming the powder charge 38 is maintained within the central cavity 50, such that at least a portion of the gunpowder 38 is accessible by the jet of burning gas projected through the flame port 30 from the primer 28.

In several embodiments, the volume of the central cavity 50 between the flame port 30 and the trailing end 42 of the projectile 40 is only slightly greater than the volume of the powder charge 38 received therein. Thus, the gunpowder forming the powder charge 38 is maintained in a relatively stable location between the flame port 30 and the trailing end 42 of the projectile 40 throughout various changes in orientation of the cartridge 12. For example, as shown in FIG. 1, orientation of the cartridge 12 in an upward direction, that is, with the leading end 18 of the casing 14 above the trailing end 16, allows the gunpowder 38 within the central cavity 50 to fall generally toward the trailing end 16 of the case, thereby allowing easy communication of burning gas from the flame port 30 to the powder charge 38. As shown in FIG. 2, orientation of the cartridge 12 in a downward direction, that is, with the leading end 18 of the casing below the trailing end 16, allows a small portion of gunpowder 38 to move from the trailing portion 52 of the central cavity into the leading portion 58 of the central cavity 50, thereby filling the leading portion 58. However, in this orientation, the majority of the gunpowder forming the powder charge 38 remains within the trailing portion 52, and only a small void is formed between the flame port 30 and the powder charge 38. Thus, in this downward orientation, flame produced by the primer 28 and directed through the flame port 30 may still readily reach and ignite the powder charge 38.

In some embodiments, the volume of the central cavity 50 between the flame port 30 and the trailing end 42 of the projectile 40 is approximately equal to the volume of the powder charge 38 received therein. Thus, minimal movement of the powder charge 38 within the central cavity 50 occurs as the orientation of the cartridge 12 is changed. In other embodiments, the volume of the central cavity 50 between the flame port 30 and the trailing end 42 of the projectile 40 may slightly exceed the volume of the powder charge 38. It will be recognized that, in such embodiments, the additional volume of the central cavity 50 may allow for slight adjustments or variance in the amount of gunpowder provided during manufacture of the cartridge 12 and/or in the depth at which the projectile 40 is seated within the case leading end 18 during manufacture of the cartridge 12.

The insert 44 is preferably fabricated from any of a variety of substantially rigid and relatively strong materials suitable to withstand the buildup of gas pressure within the central cavity 50 due to combustion of the powder charge 38 absent significant deformation or fracturing of the insert 44 such as would likely impede expulsion of the projectile 40 from the leading end 18 of the case 14. For example, in the illustrated embodiment, the insert 44 is fabricated from a substantially rigid and durable polymer material. However, it will be recognized that numerous other suitable materials, including but not limited to metal, wood, ceramic, and the like, may be used for fabrication of the insert 44 without departing from the spirit and scope of the present general inventive concept. Furthermore, it will be recognized that the insert 44 may be fabricated from a number of flexible and/or deformable materials, such as for example polymer foam, rubber, gel, or the like, without departing from the spirit and scope of the present general inventive concept.

Figure 3:
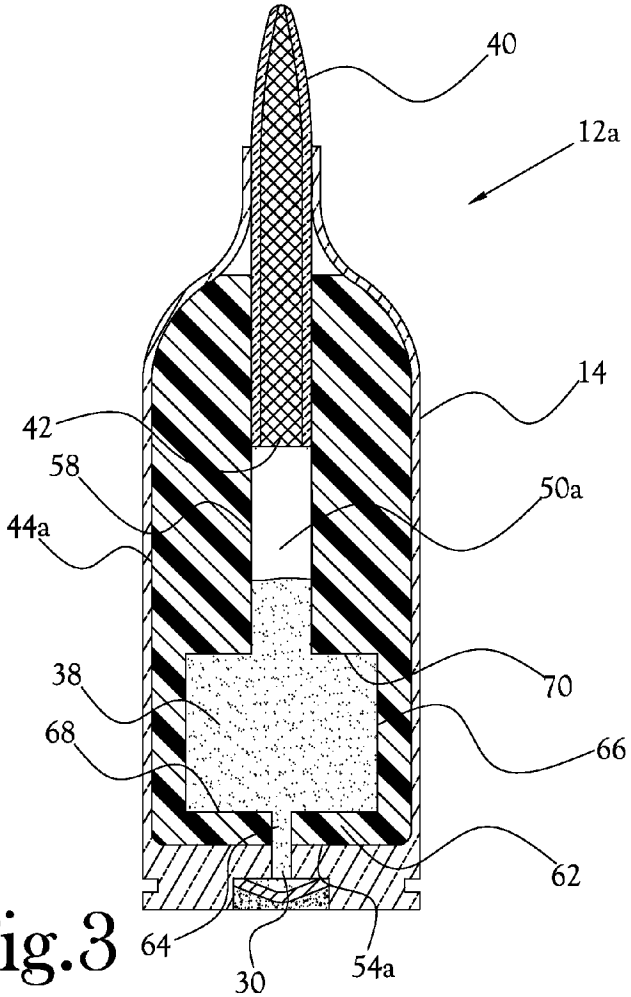
FIG. 3 is a cross-sectional side view of another embodiment of a round of firearm ammunition embodying various features of the present general inventive concept.

FIG. 3 depicts another embodiment of a cartridge 12*a* constructed in accordance with several features of the present general inventive concept. In the embodiment of FIG. 3, the insert 44*a* defines an integrally-formed annular plate portion 62 extending along a trailing end 54*a* thereof. The central cavity 50*a* of the insert 44*a* defines a trailing portion 64 axially aligned with the flame port 30 of the case 14, and having a diameter approximately equal to the diameter of the flame port 30. On a leading side of the plate portion 62 of the insert 44*a*, the trailing portion 64 of the central cavity 50*a* transitions to a central portion 66 having a relatively wide diameter and forming a chamber for containment of the majority of the gunpowder forming the powder charge 38. The central portion 66 of the central cavity 50*a* transitions to a leading portion 58 having a diameter narrower than that of the central portion 66, and in the illustrated embodiment, approximately equal to the outer diameter of the projectile 40.

In the embodiment of FIG. 3, the majority of the powder charge 38 is maintained within the central portion 66 of the central cavity 50*a*, between the plate portion 62 of the insert 44*a* and the leading portion 58 of the central cavity 50*a*. Thus, upon ignition of the powder charge 38, gas pressure buildup within the case 14 results in the application of such pressure against a leading surface 68 of the plate portion 62 of the insert 44*a*, as well as against a leading surface 70 of the central portion 66 of the central cavity 50*a*, between the central and leading portions 66, 58 of the central cavity 50*a*. It will be recognized that these applications of pressure within the central portion 66 of the central cavity 50*a* may act upon the insert 44*a* in opposition to one another, thereby reducing bias of the insert 44*a* in relation to the case 14 during combustion of the powder charge 38. Thus, the plate portion 62 of the insert 44*a*, together with the constriction of the central cavity 50*a* between the central and leading portions 66, 58, may assist in discouraging gas pressure within the insert 44*a* from dislodging or otherwise shifting the insert 44*a* along the length of the case 14 during combustion of the powder charge 38, or from deforming the tapered portion 48 of the case 14 during combustion of the powder charge 38.

Figure 4:
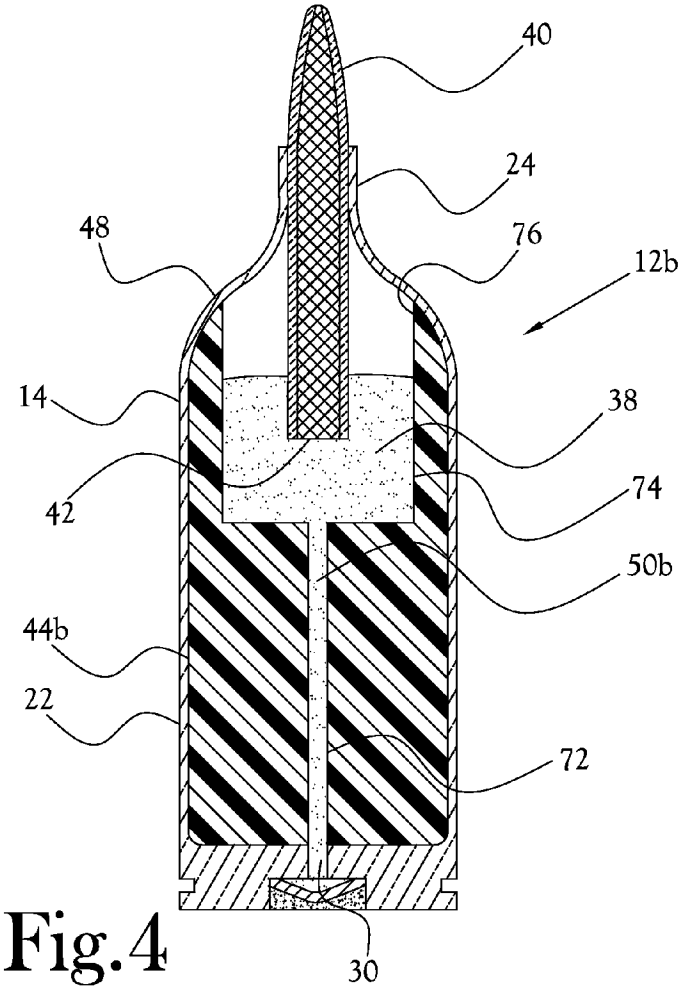
FIG. 4 is a cross-sectional side view of another embodiment of a round of firearm ammunition embodying various features of the present general inventive concept.

FIG. 4 illustrates another embodiment of a cartridge 12*b* constructed in accordance with several features of the present general inventive concept. In the embodiment of FIG. 4, the central cavity 50*b* of the insert 44*b* defines a cylindrical trailing portion 72 which is axially aligned with, and opens to, the flame port 30 of the case 14, and which has a diameter approximately equal to the diameter of the flame port 30. The central cavity 50*b* transitions to a relatively wide, cylindrical leading portion 74 which opens axially to a leading end 76 of the insert 44*b*, proximate the tapered portion 48 of the case 14. In this embodiment, the powder charge 38 is disposed in the space defined by the central cavity 50*b* in combination with the tapered portion 48 of the case 14 between the trailing tubular portion 22 and the leading tubular portion 24. In operation of the embodiment of FIG. 4, upon activation of the primer 28, a flame is emitted through the flame port 30 and is directed along the trailing portion 72 of the insert 44*b* and into the leading portion74, whereupon the flame may ignite the powder charge 38, thereby causing the round 12*b* to fire.

In the illustrated embodiment, the portion of the exterior surface of the insert 44*b* proximate the leading end 76 defines a slight taper, such that the leading end 76 of the insert 4*b* conforms to a trailing portion of the interior surface of the tapered portion 48 of the case 14. Thus, as in the embodiment of FIGS. 1 and 2 discussed above, the tapered portion 48 of the case 14 serves to secure the insert 44*b* generally within the case interior 32 along the length of the trailing tubular portion 22. In other embodiments, the exterior surface of the insert 44 is cylindrical in shape, and does not include a tapered leading portion. In such embodiments, the insert 44 may terminate at a leading end of the trailing tubular portion 22 of the case 14 and may be sized such that the insert 44 is prevented from sliding axially along the case 14 into the tapered portion 48. Thus, in such embodiments, the tapered portion 48 of the case 14 also serves to secure the insert 44 generally within the case interior 32 along the length of the trailing tubular portion 22.

In a method of manufacture of an ammunition cartridge 12, a case is formed defining a primer port 26 and a flame port 30 as discussed above, and also having a generally tubular, straight side wall with a diameter approximately equal to the diameter of the trailing portion 16 of the case 14. An insert 44 is inserted into an interior of the case, and thereafter, the diameter of a leading end of the case is reduced via axially-inward compression or other means known to one of skill in the art. Thus, the insert 44 is secured within the case 14 via formation of the "necked down" leading tubular portion 24 of the case 14.

In some embodiments, the method of manufacture of the round of ammunition may further comprise fixation of a primer 28 within the primer port 26, placement of a measure of powder 38 at least within the case 14, and preferably within the central cavity 50 of the insert 44 received within the case 14, and placement of a projectile 40 within the leading tubular portion 24 of the case 14. Those of skill in the art will recognize that numerous swaging and other shaping and/or forming operations known in the field of firearm ammunition manufacture, such as for example flaring the leading end of the case 14 prior to insertion of the projectile 40 into the leading tubular portion 24 of the case 14, crimping the leading end of the case 14 following placement of the projectile 40 therein, and/or swaging the length of the case 14 to a specific outer diameter, may be incorporated into the method of manufacture at any of various points throughout the method without departing from the spirit and scope of the present general inventive concept.

From the foregoing description, it will be appreciated that an insert for use in a firearm ammunition cartridge, and a firearm ammunition cartridge employing such an insert, have been provided. The above-described insert significantly increases the reliability of the ammunition cartridge to fire a projectile of the cartridge in a desired manner throughout a broad range of orientations of the cartridge. While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A firearm ammunition cartridge comprising:

a case having a substantially tubular body portion, an open leading end, and a trailing end defining a primer port, said primer port opening to an interior of said case;

an insert received within said case and extending along said body portion, said insert having an exterior surface conforming to an interior surface of said body portion and a central cavity extending along an axial dimension of said insert, said central cavity opening to said primer port at said trailing end of said case and opening to a leading end of said insert;

a quantity of gunpowder disposed within said central cavity; and a projectile received and retained within said leading end of said case;

whereby said gunpowder is confined to a chamber comprising at least a portion of said central cavity between said case trailing end and said projectile;

wherein said central cavity is configured to define at least a cylindrical first portion having a first diameter, and a cylindrical second portion having a second diameter, the second diameter being formed sufficiently larger than the first diameter such that a majority of said gunpowder is maintained within said second portion;

said central cavity defining the first portion as a leading portion having the first diameter and the second portion as a trailing portion having the second diameter; and whereby the insert is configured to remain in the case after combustion of the gunpowder.

2. The firearm ammunition cartridge of claim 1, wherein a trailing end of said projectile closes a leading end of said central cavity.

3. The firearm ammunition cartridge of claim 2 wherein said quantity of gunpowder defines a volume approximately equal to a volume of said central cavity between said trailing end of said projectile and said trailing end of said case.

4. The firearm ammunition cartridge of claim 1, said first portion and said second portion of said central cavity being coaxial with one another and with an axial dimension of said primer port.

5. The firearm ammunition cartridge of claim 4, said first portion being configured as a leading portion of said central cavity having a diameter substantially equal to a trailing end of said projectile.

6. The firearm ammunition cartridge of claim 5, said trailing end of said projectile being received within said leading portion of said central cavity.

7. The firearm ammunition cartridge of claim 4, said central cavity further defining a cylindrical third portion having a third diameter.

8. The firearm ammunition cartridge of claim 7, said first portion defined as a leading portion of said central cavity having a diameter substantially equal to a trailing end of said projectile, said third portion defined as a trailing portion of said central cavity having a diameter substantially equal to a diameter of said primer port, and said second portion defined as a central portion of said central cavity having a diameter greater than said diameter of said leading portion and said diameter of said trailing portion, said trailing end of said projectile being received within said leading portion of said central cavity.

9. The firearm ammunition cartridge of claim 4, said insert being fixed within said case.

10. The firearm ammunition cartridge of claim 9, said case defining a tapered portion between said body portion and said leading end, said exterior surface of said insert having a leading portion conforming to an interior surface of said tapered portion of said case, whereby said tapered portion retains said insert within said case between said tapered portion and said trailing end of said case.

11. The firearm ammunition cartridge of claim 1, wherein the insert is configured to be non-combustible.

12. The firearm ammunition cartridge of claim 1, wherein the insert is formed of a rigid material configured to withstand the combustion of the gunpowder without deformation.

13. An insert for a firearm ammunition case comprising:

a substantially rigid member defining a leading end, an opposite trailing end, and an exterior surface between said leading and trailing ends, said exterior surface being shaped to conform to at least a portion of an interior surface of a firearm ammunition case between a trailing end of the case and a leading tapered portion of the case, said member further defining a central cavity extending between and opening to said leading and trailing ends of said member, said central cavity being sized to receive a quantity of gunpowder therein, said central cavity being configured to define at least a cylindrical first portion having a first diameter, and a cylindrical second portion having a second diameter, the second diameter being formed sufficiently larger than the first diameter such that a majority of said gunpowder is maintained within said second portion, said central cavity defining the first portion as a leading portion having the first diameter and the second portion as a trailing portion having the second diameter, and said substantially rigid member being configured to remain in the case after combustion of the gunpowder.

14. The insert of claim 13, said exterior surface defining a tapered portion proximate said leading end, said tapered portion being shaped to conform to an interior surface of a tapered portion of a firearm ammunition case.

15. The insert of claim 13, said leading portion of said central cavity having a diameter substantially equal to a trailing end of an ammunition projectile.

16. The insert of claim 13, said first portion and said second portion of said central cavity being coaxial with one another and with an axial dimension of said exterior surface.

* * * * *